US007906907B2

(12) United States Patent
Soh et al.

(10) Patent No.: US 7,906,907 B2
(45) Date of Patent: Mar. 15, 2011

(54) PLASMA DISPLAY PANEL (PDP)

(75) Inventors: Hyun Soh, Suwon-si (KR); Joong-Ho Moon, Suwon-si (KR); Jin-Won Han, Suwon-si (KR)

(73) Assignee: Samsung SDI Co., Ltd., Giheung-gu, Yongin-si, Gyeonggi-do (KR)

( * ) Notice: Subject to any disclaimer, the term of this patent is extended or adjusted under 35 U.S.C. 154(b) by 398 days.

(21) Appl. No.: 12/010,323

(22) Filed: Jan. 23, 2008

(65) Prior Publication Data

US 2008/0174245 A1 Jul. 24, 2008

(30) Foreign Application Priority Data

Jan. 24, 2007 (KR) ..... 10-2007-0007639

(51) Int. Cl.
*H01J 17/49* (2006.01)

(52) U.S. Cl. ..... 313/582; 313/583; 313/584; 313/585; 313/586; 313/587

(58) Field of Classification Search ..... 313/582
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
RE37,444 E 11/2001 Kanazawa
6,566,812 B1 * 5/2003 Torisaki et al. ..... 313/586
(Continued)

FOREIGN PATENT DOCUMENTS

JP 2845183 10/1998
(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner* — Nimeshkumar D. Patel
*Assistant Examiner* — Jacob Stern
(74) *Attorney, Agent, or Firm* — Robert E. Bushnell, Esq.

(57) ABSTRACT

A Plasma Display Panel (PDP) includes: a first substrate and a second substrate, a plurality of barrier ribs disposed between the substrates to define discharge cells and including single walled barrier ribs and double walled barrier ribs, a plurality of discharge electrodes disposed on portions of the panel corresponding to the barrier ribs to supply a discharge voltage to the discharge cells, and phosphor layers formed in the discharge cells. The barrier ribs include single wall barrier ribs and double wall barrier ribs. The discharge electrodes disposed on the single wall barrier ribs are commonly used to generate a discharge in the adjacent discharge cells, and thus, discharge areas can be extended. Also, since the discharge spaces of the discharge cells are asymmetrically formed, the brightness of discharge cells that have a relatively low brightness can be increased.

13 Claims, 3 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 6,930,451 | B2 * | 8/2005 | Terao et al. | 313/587 |
| 6,992,444 | B2 * | 1/2006 | Hashikawa et al. | 313/587 |
| 7,030,562 | B2 * | 4/2006 | Tachibana et al. | 313/583 |
| 7,071,621 | B1 * | 7/2006 | Namiki et al. | 313/584 |
| 7,224,120 | B2 * | 5/2007 | Min | 313/582 |
| 2005/0017637 | A1 * | 1/2005 | Kang et al. | 313/582 |
| 2005/0023979 | A1 * | 2/2005 | Kang | 313/582 |
| 2005/0242696 | A1 * | 11/2005 | Song | 313/292 |
| 2006/0082304 | A1 * | 4/2006 | Song | 313/582 |
| 2006/0082305 | A1 * | 4/2006 | Kim | 313/582 |
| 2007/0159102 | A1 * | 7/2007 | Min | 313/582 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |

* cited by examiner

PLASMA DISPLAY PANEL (PDP)

CLAIM OF PRIORITY

This application makes reference to, incorporates the same herein, and claims all benefits accruing under 35 U.S.C. §119 from an application earlier filed in the Korean Intellectual Property Office on 24 Jan. 2007 and there duly assigned Serial No. 10-2007-0007639.

BACKGROUND OF THE INVENTION

1. Field of the Invention

The present invention relates to a Plasma Display Panel (PDP), and more particularly, the present invention relates to a PDP having a structure that minimizes regions that reduce a discharge space and brightness in a discharge cell.

2. Description of the Related Art

A PDP is a flat panel display device that displays desired numbers, letters, or graphics using visible light emitted from phosphor layers which are excited by ultraviolet rays generated during a gas discharge initiated by supplying a DC or AC voltage to a plurality of electrodes formed on a plurality of substrates after a discharge gas is sealed between the plurality of substrates.

Generally, Plasma Display Panels (PDPs) can be classified into Direct Current (DC) PDPs and Alternating Current (AC) PDPs according to the type of driving voltage supplied to discharge cells, i.e., according to their discharge type. PDPs can further be classified into face discharge PDPs and surface discharge PDPs according to the arrangement of their electrodes.

A conventional three-electrode surface discharge PDP includes: a first substrate, a second substrate facing the first substrate, sustain discharge electrode pairs each having an X electrode and a Y electrode formed on an inner surface of the first substrate, a first dielectric layer that buries the sustain discharge electrode pairs, a protective film layer formed on a surface of the first dielectric layer, a plurality of address electrodes formed on an inner surface of the second substrate in a direction crossing the sustain discharge electrode pairs, a second dielectric layer that buries the address electrodes, barrier ribs formed between the first and second substrates to define a plurality of discharge cells, and red, green, and blue phosphor layers formed in the discharge cells. A discharge gas is filled in a space formed by mating the first and second substrates to form discharge regions.

In the conventional three-electrode surface discharge PDP having the above structure, when an electrical signal is supplied to the address electrodes and the Y electrode, discharge cells for emitting light are selected, and electrical signals are alternately supplied to the X electrode and the Y electrode. Thus, a surface discharge is generated from a surface of the first substrate, and ultraviolet rays generated as a result of the surface discharge excite phosphor layers coated on the selected discharge cells. Accordingly, visible light is emitted from phosphor materials of the phosphor layers, and thus, a stationary or moving image can be displayed.

In the conventional three-electrode surface discharge PDP, the gas discharge in the discharge cells is generated by controlling a voltage supplied to the X electrode, the Y electrode, and the address electrodes, and as a result of the gas discharge, visible light is emitted.

Recently, research have been conducted on panel structures that can increase brightness by changing a discharge electrode structure and can increase discharge efficiency by increasing a discharge space.

SUMMARY OF THE INVENTION

To solve the above and/or other problems, the present invention provides a Plasma Display Panel (PDP) having increased brightness by improving a discharge aperture ratio through the modification of a structure of its discharge electrodes.

The present invention also provides a PDP having increased discharge efficiency by increasing a discharge space through the modification of locations of the discharge electrodes.

According to one aspect of the present invention, a Plasma Display Panel (PDP) is provided including: a first substrate and a second substrate; a plurality of barrier ribs disposed between the substrates to define discharge cells and including single walled barrier ribs and double walled barrier ribs; a plurality of discharge electrodes disposed on portions of the panel corresponding to the barrier ribs to supply a discharge voltage to the discharge cells; and phosphor layers formed in the discharge cells.

The discharge spaces of the discharge cells may be defined by the barrier ribs into discharge cells having different discharge spaces from each other. The discharge spaces of the discharge cells may have an asymmetrical structure. The discharge spaces of the discharge cells may be defined to have different areas corresponding to changes of the thickness of the barrier ribs.

The barrier ribs may include first barrier ribs arranged in a first direction of the PDP and second barrier ribs arranged in a second different direction of the PDP and connected to the first barrier ribs.

The first barrier ribs may include single walled barrier ribs, each single walled barrier rib arranged between adjacently disposed discharge cells, and double walled barrier ribs, each double walled barrier rib arranged between a pair of adjacently disposed discharge cells and another pair of neighbored discharge cells and including a plurality of barrier ribs having a gap therebetween.

The gaps in the double wall barrier ribs may be arranged in a direction of the PDP to be used as a path for discharging an exhaust gas.

The discharge electrodes may include X and Y electrodes, each of the X electrodes including an X transparent electrode and an X bus electrode electrically connected to the X transparent electrode, and each of the Y electrodes including a Y transparent electrode and a Y bus electrode electrically connected to the Y transparent electrode.

Each of the X bus electrodes may include an X bus electrode line and a plurality of X protrusion electrodes, the X bus electrode line is arranged on the single wall barrier rib, and the X protrusion electrode includes a first X protrusion electrode and a second X protrusion electrode respectively arranged on the second barrier ribs connected to both sides of a single wall barrier rib.

The X transparent electrodes may respectively protrude into the discharge spaces of the adjacent discharge cells from the both sides of the X bus electrode line.

Each of the Y bus electrodes may include a Y bus electrode line and a plurality of Y protrusion electrodes extending from the Y bus electrode line, the Y bus electrode line is arranged on the double wall barrier rib, and the Y protrusion electrodes are arranged on the second barrier ribs.

The Y transparent electrodes may respectively protrude into the discharge spaces of the discharge cells from a side of the Y bus electrode line.

The single wall barrier ribs may have different widths in different discharge cells corresponding to variations of widths of the X bus electrode in each of the discharge cells.

An area of the discharge space of the discharge cell in which the X bus electrode has a relatively wide width may be smaller than an area of the discharge space of the discharge cell in which the X bus electrode has a relatively narrow width.

The discharge electrode may have an X-YY structure in which the X electrodes that commonly relate to the discharge in the adjacent discharge cells are disposed on the single wall barrier ribs and the Y electrodes are disposed on the double wall barrier ribs.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully below with reference to the accompanying drawings in which exemplary embodiments of the present invention are shown.

Figure 1:
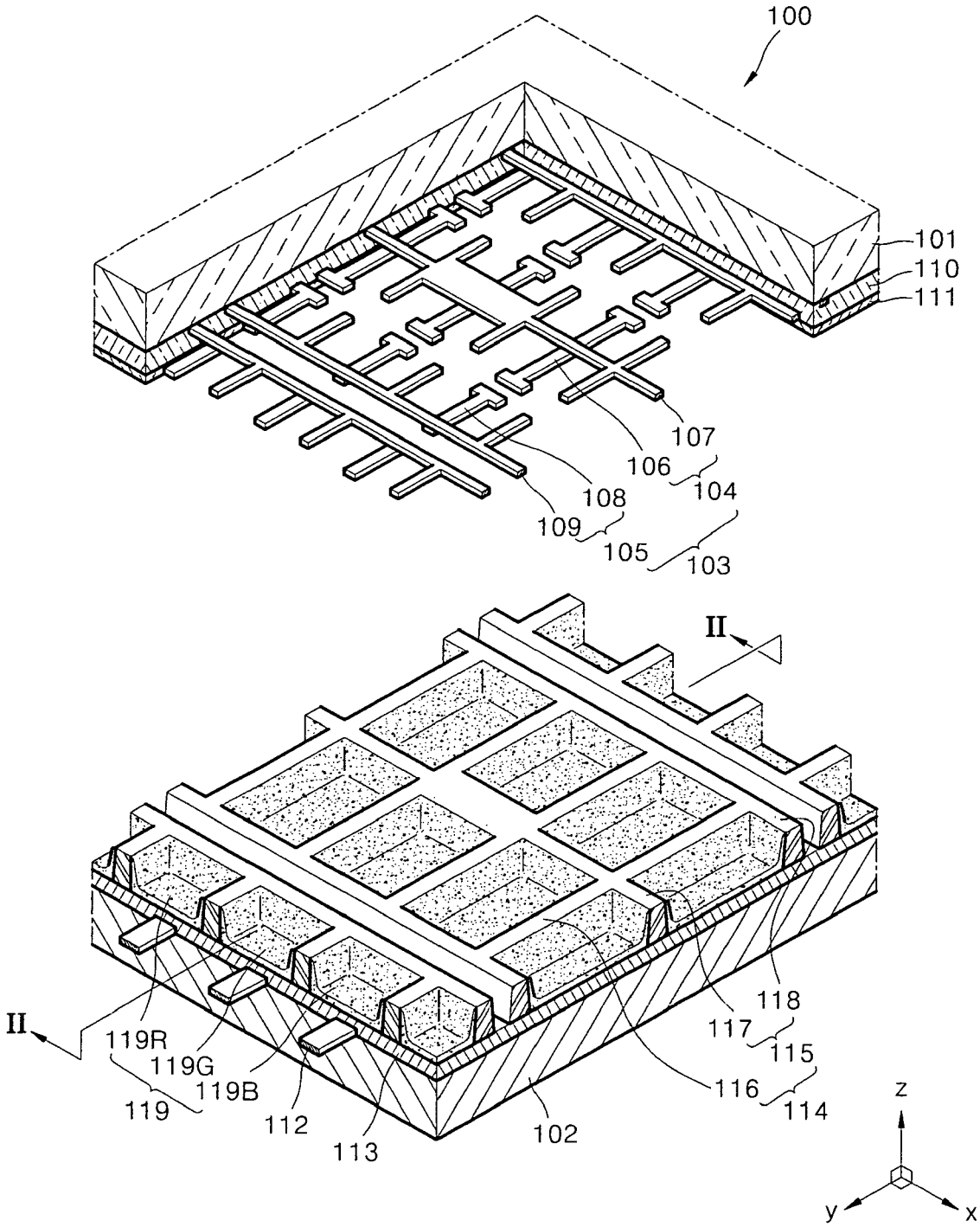
FIG. 1 is a partial cut-away exploded perspective view of a three-electrode surface discharge PDP according to an embodiment of the present invention.
Figure 2:
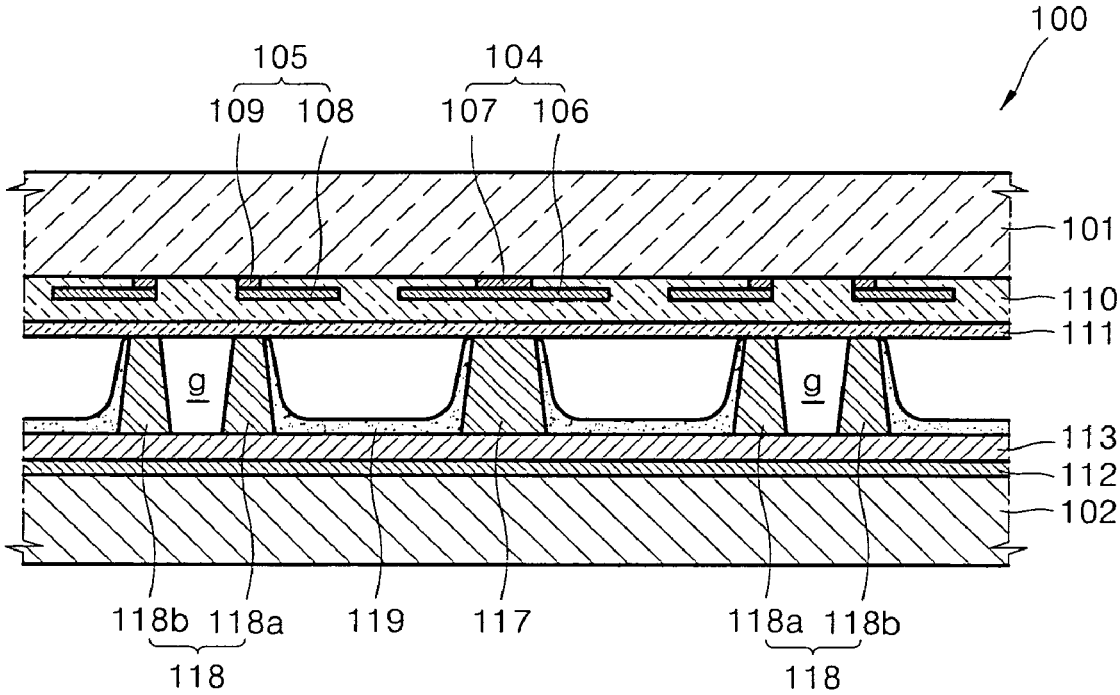
FIG. 2 is a cross-sectional view taken along line II-II of FIG. 1, according to an embodiment of the present invention.

FIG. 1 is a partial cut-away exploded perspective view of a three-electrode surface discharge PDP 100 according to an embodiment of the present invention. FIG. 2 is a cross-sectional view taken along line II-II of FIG. 1, and FIG. 3 is a plan view of discharge electrodes of the three-electrode surface discharge PDP 100 of FIG. 1, according to an embodiment of the present invention.

Figure 3:
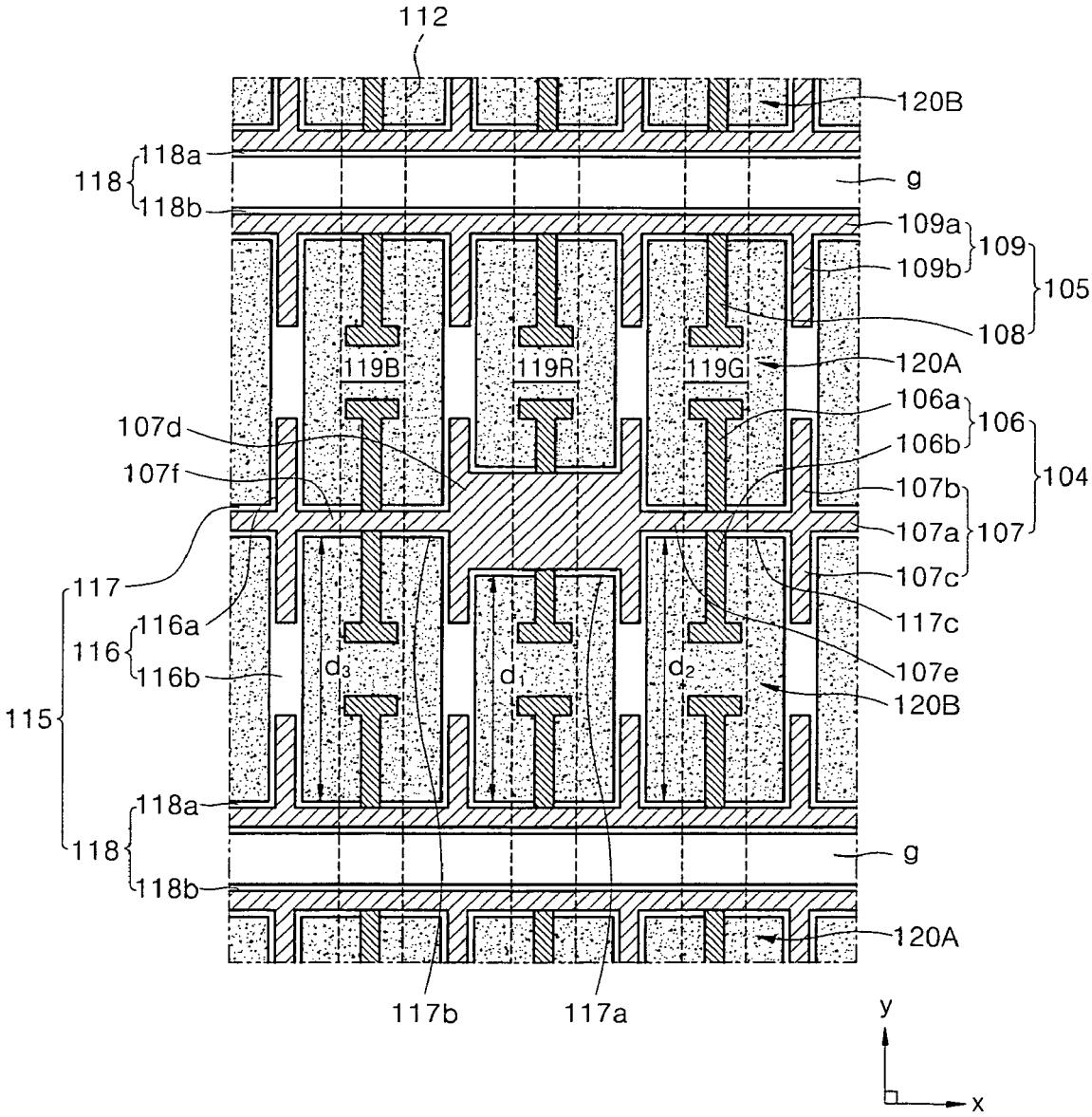
FIG. 3 is a plan view of discharge electrodes of the three-electrode surface discharge PDP of FIG. 1, according to an embodiment of the present invention.

Referring to FIGS. 1 through 3, the three-electrode surface discharge PDP 100 includes a first substrate 101 and a second substrate 102 facing the first substrate 101. Frit glass (not shown) is coated along edges of inner surfaces of the first substrate 101 and the second substrate 102 to seal the discharge cells.

The first substrate 101 is a transparent substrate formed of, for example, soda lime glass. Alternatively, the first substrate 101 can be a semi-transparent substrate, a colored substrate, or a reflection plate.

X electrodes 104 and Y electrodes 105, which form sustain discharge electrode pairs 103, are disposed on an inner surface of the first substrate 101 along an X direction of the three-electrode surface discharge PDP 100. Each of the X electrodes 104 includes an X transparent electrode 106 and an X bus electrode 107 connected to the X transparent electrode 106. Each of the Y electrodes 105 includes a Y transparent electrode 108 and a Y bus electrode 109 connected to the Y transparent electrode 108.

The X electrodes 104 and the Y electrodes 105 are buried by a first dielectric layer 110. The first dielectric layer 110 can be formed of a high dielectric material, for example, ZnO—$B_2O_3$—$Bi_2O_3$. The first dielectric layer 110 can be selectively formed in regions where the X electrodes 104 and the Y electrodes 105 are formed, or can be formed in all areas of an inner surface of the first substrate 101.

A protective film layer 111 is deposited on a surface of the first dielectric layer 110 using, for example, MgO to prevent the first dielectric layer 110 from being damaged and to increase the emission of secondary electrons.

The second substrate 102 can be formed of substantially the same material as the first substrate 101. A plurality of address electrodes 112 are disposed on an inner surface of the second substrate 102 in a direction crossing the sustain discharge electrode pairs 103. The address electrodes 112 are buried in a second dielectric layer 113. The second dielectric layer 113 is formed of a high dielectric material, for example, PbO—$B_2O_3$—$SiO_2$. A barrier rib structure 114 that defines a plurality of discharge cells together with the first substrate 101 and the second substrate 102 is formed between the first and second substrates 101 and 102.

The discharge cells defined by the combination of the first substrate 101, the second substrate 102, and the barrier rib structure 114 are filled with a discharge gas, such as Ne—Xe gas or He—Xe gas.

Also, red, green, and blue phosphor layers 119 for emitting visible light by being excited by ultraviolet rays generated by the discharge gas are formed in the discharge cells. The phosphor layers 119 can be coated in any region in the discharge cells.

The phosphor layers 119 include red, green, and blue phosphor materials, but are not limited thereto. That is, the phosphor layers 119 can be replaced by different color phosphor layers, or an additional different phosphor layer can be added. In the present embodiment, the red phosphor layer 119R may be formed of $(Y,Gd)BO_3:Eu^{+3}$, the green phosphor layer 119G may be formed of $Zn_2SiO_4:Mn^{2+}$, and the blue phosphor layer 119B may be formed of $BaMgAl_{10}O_{17}:Eu^{2+}$.

The barrier rib structure 114 has a structure including single walled barrier ribs 117 and double walled barrier ribs 118, and the X electrodes 104 and the Y electrodes 105 are disposed on portions of the first substrate 101 corresponding to the barrier rib structure 114. A discharge space of the discharge cell is divided into spaces having areas different from each other.

Referring to FIGS. 1 through 3, the barrier rib structure 114 includes first barrier ribs 115 disposed in the X direction of the PDP 100 and second barrier ribs 116 disposed in the Y direction of the PDP 100. The first barrier ribs 115 are disposed in a direction crossing the address electrodes 112, and the second barrier ribs 116 are disposed parallel to the address electrodes 112.

Both the first barrier ribs 115 and second barrier ribs 116 substrates have a stripe shape and define discharge cells by being connected to each other. For example, the discharge cells defined by the coupling of the first barrier ribs 115 and the second barrier ribs 116 have rectangular shape horizontal cross-sections. The structure of the barrier rib structure 114 according to the present embodiment is not limited to the above configuration, and can have various shapes as long as they can define discharge cells, such as a different rectangular shape, a circular shape, or an oval shape besides the rectangular shape.

The first barrier ribs 115 have a structure including the single walled barrier ribs 117 and the double walled barrier ribs 118.

That is, one single walled barrier rib 117 formed of one walled barrier rib is disposed between a first discharge cell

120A and a second discharge cell 120B adjacently disposed in the Y direction of the PDP 100.

Unlike the single walled barrier rib 117, the double walled barrier ribs 118 including a plurality of barrier ribs 118*a* and 118*b* is disposed between a pair of the first discharge cell 120A and the second discharge cell 120B, and another pair of the first discharge cell 120A and the second discharge cell 120B.

A gap g is formed between the plurality of barrier ribs 118*a* and 118*b*. The gap g is formed along the X direction of the PDP 100, and is used for an exhaust gas path when the discharge cells are vacuumed.

Alternatively, instead of forming the gap g in the double walled barrier rib 118, a single layer can be divided into a double walled barrier rib by forming a groove having a predetermined size in the single walled barrier rib. The double walled barrier rib having the groove may have a total width identical to the total width of the plurality of barrier ribs 118*a* and 118*b* with the gap g.

The first barrier ribs 115 include the single walled barrier ribs 117 and the double walled barrier ribs 118 are alternately disposed in the Y direction of the PDP 100. That is, the single walled barrier rib 117 is disposed in the center between the first and second discharge cells 120A and 120B which are adjacently disposed in the Y direction of the PDP 100, and the double walled barrier ribs 118 is disposed with a gap g between a pair of the first and second discharge cells 120A and 120B and an adjacent pair of the first and second discharge cells 120A and 120B.

The X and Y electrodes 104 and 105 are alternately disposed on the first barrier ribs 115.

That is, X bus electrode lines 107*a* are formed on the single walled barrier ribs 117. The X bus electrode lines 107*a* are disposed in a stripe shape on corresponding regions of upper parts of the single walled barrier ribs 117 in a direction in which the single walled barrier ribs 117 are disposed.

A first X protrusion electrode 107*b* and a second X protrusion electrode 107*c* protrude from both sides of each of the X bus electrode lines 107*a*. The first X protrusion electrode 107*b* extends a predetermined length on a portion of the second barrier rib 116*a* in a direction corresponding to the direction in which the first discharge cell 120A is disposed. The second X protrusion electrode 107*c* extends a predetermined length on a portion of the second barrier rib 116*b* in a direction corresponding to the direction in which the second discharge cell 120B is disposed.

Accordingly, the X bus electrode 107 includes the X bus electrode lines 107*a* disposed on the single walled barrier rib 117 and the first X protrusion electrode 107*b* and the second X protrusion electrode 107*c* extend from the side of the X bus electrode lines 107*a* and disposed on the second barrier ribs 116*a* and 116*b*. The X bus electrode 107 is formed of a highly conductive material, such as an Ag paste.

The X bus electrode lines 107*a* are disposed in each of the discharge cells with different widths. For example, a portion of a X bus electrode line 107*d* disposed on the single walled barrier rib 117 that defines the discharge cell in which a red phosphor layer 119R is coated has a relatively wide width, and portions of the X bus electrode lines 107*e* and 107*f* disposed on the single walled barrier ribs 117 that define the discharge cells in which a green phosphor layer 119G and a blue phosphor layer 119B are coated have a relatively narrow width.

Furthermore, the line width of the X bus electrode line 107*e* disposed on the single walled barrier rib 117 that defines the discharge cell in which the green phosphor layer 119G is coated and the line width of the X bus electrode line 107*f* disposed on the single walled barrier rib 117 that defines the discharge cell in which the blue phosphor layer 119B is coated can be identical or different.

The line widths of the X bus electrode lines 107 formed in each discharge cells are different from each other along the lengthwise direction of the single walled barrier rib 117 are different. Accordingly, the widths of the single walled barrier ribs 117 are also different from each other corresponding to the widths of the X bus electrode lines 107.

Also, a first X transparent electrode 106*a* and a second X transparent electrode 106*b* that respectively extend towards the first discharge cell 120A and the second discharge cell 120B from the X bus electrode line 107*a* are electrically connected to the X bus electrode 107.

That is, the first X transparent electrode 106*a* and the second X transparent electrode 106*b* are respectively formed in the center of the first discharge cell 120A and the second discharge cell 120B. The arrangement of the first X transparent electrode 106*a* and the second X transparent electrode 106*b* is not limited to the above configuration. For example, the first X transparent electrode 106*a* and the second X transparent electrode 106*b* can be connected to each other in one unit, or can respectively extend from both sides of the X bus electrode line 107*a*. The first X transparent electrode 106*a* and the second X transparent electrode 106*b* are formed of a transparent conductive film, such as an ITO film, in order to increase an aperture ratio of the PDP 100.

Since the X bus electrode line 107 is disposed on the single walled barrier rib 117, the first X transparent electrode 106*a* is disposed in the first discharge cell 120A, and the second X transparent electrode 106*b* is disposed in the second discharge cell 120B, the X electrode 104 commonly relates to the discharges of the first discharge cell 120A and the second discharge cell 120B.

A Y bus electrode line 109*a* is disposed on the double walled barrier rib 118. The Y bus electrode line 109*a* is formed in a stripe shape in a corresponding region of the double walled barrier rib 118 along the direction of the double walled barrier rib 118.

Y protrusion electrodes 109*b* protrude from a side of the Y bus electrode line 109*a* and are formed on the second barrier ribs 116. The Y protrusion electrodes 109*b* extend a predetermined length on the second barrier ribs 116 in a direction in which the first discharge cell 120A or the second discharge cell 120B is disposed.

Thus, the Y bus electrode 109 includes the Y bus electrode lines 109*a* disposed on the double walled barrier ribs 118 and the Y protrusion electrodes 109*b* extend from the Y bus electrode line 109*a* and are disposed on the second barrier ribs 116. The Y bus electrode 109 is formed of a highly conductive material, such as an Ag paste.

The Y transparent electrodes 108 disposed towards the first discharge cell 120A or the second discharge cell 120B are electrically connected to the Y bus electrode line 109*a*. The Y transparent electrodes 108 are disposed in the center of the first discharge cell 120A or the second discharge cell 120B. The Y transparent electrodes 108 can be formed of a transparent conductive film, such as an ITO film, to increase an aperture ratio of the PDP 100.

Since the Y bus electrode line 109*a* is disposed on the double walled barrier rib 118, the Y protrusion electrodes 109*b* are formed in the first discharge cell 120A and the second discharge cell 120B, and the Y electrode 105 independently relate to the discharges in the first discharge cell 120A and the second discharge cell 120B.

As described above, the PDP 100 has a structure, a so called X-YY electrode structure, in which, when the structure is viewed based on the first discharge cells 120A and the second discharge cells 120B adjacently disposed in a direction of the PDP 100, the X bus electrode line 107*a* is disposed on the single walled barrier rib 117 located between the first discharge cells 120A and the second discharge cells 120B, the first X transparent electrode 106*a* and the second X transparent electrode 106*b* which are electrically connected to the X bus electrode lines 107*a* respectively protrude in the first discharge cells 120A and the second discharge cells 120B, Y bus electrode lines 109*a* are respectively disposed on the barrier ribs 118*a* and 118*b* of the double walled barrier rib 118, and the Y transparent electrodes 108 which are electrically connected to the Y bus electrode line 109*a* respectively protrude towards the first discharge cells 120A and the second discharge cells 120B.

Also, the first X transparent electrode 106*a* and the Y transparent electrodes 108 maintain a predetermined discharge gap in the first discharge cells 120A, and the second X transparent electrode 106*b* and the Y transparent electrodes 108 maintain a discharge gap in the second discharge cells 120B. Therefore, a discharge can primarily be initiated from the discharge gaps.

Furthermore, the first X protrusion electrode 107*b* and the second X protrusion electrode 107*c* extend from the X bus electrode lines 107*a* and are disposed on the second barrier ribs 116*a* and 116*b*, and the Y protrusion electrodes 109*b* extend from the Y bus electrode line 109*a* and is disposed on the second barrier ribs 116.

Also, the first X protrusion electrode 107*b* and the Y protrusion electrodes 109*b* maintain a predetermined gap, and the second X protrusion electrode 107*c* and the Y protrusion electrodes 109*b* also maintain a predetermined gap. Accordingly, the generation of a surface discharge and a facing discharge is possible in the discharge cells.

In order to increase the aperture ratio of the PDP 100, the widths of the single walled barrier ribs 117 in the discharge cells are different from each other since the widths of the X bus electrode lines 107*a* in the discharge cells are different from each other.

Accordingly, the discharge spaces of the discharge cells in which the red phosphor layer 119R, the green phosphor layer 119G, and the blue phosphor layer 119B are coated are defined with different areas. That is, the widths of the discharge cells in the X direction of the PDP 100 are the same. However, the widths of the discharge cells in the Y direction are different from each other.

For example, a gap d1 of the discharge space of the discharge cell in which the red phosphor layer 119R is coated is relatively small. However, a gap d2 of the discharge space of the discharge cell in which the green phosphor layer 119R is coated or a gap d3 of the discharge space of the discharge cell in which the green phosphor layer 119G is coated is relatively large. The gaps d2 and d3 of the discharge spaces of the discharge cells in which the green phosphor layer 119G and the blue phosphor layer 119B are coated can be the same or different.

Accordingly, the PDP 100 has an asymmetrical discharge cell structure in which the discharge space of the discharge cell in which the red phosphor layer 119R is coated is relatively small and the discharge spaces of the discharge cells in which the green phosphor layer 119G and the blue phosphor layer 119B are coated are relatively large.

The operation of the PDP 100 having the above structure according to the present invention is described below with reference to FIGS. 1 through 3.

First, when a predetermined pulse voltage is supplied between the Y electrodes 105 and the address electrodes 112, discharge cells which will be lit are selected and wall charges are accumulated on inner walls of the selected discharge cells.

Next, when a "+" voltage is supplied to the X electrodes 104 and a voltage relatively higher than the "+" voltage is supplied to the Y electrodes 105, the wall charges move due to a voltage difference between the X electrodes 104 and the Y electrodes 105.

Due to the movement of the wall charges, the wall charges collide with discharge gas atoms in the discharge cells to cause a discharge. As a result of the discharge, a plasma is generated, and the discharge expands from the discharge gaps between the X transparent electrodes 106 and the Y transparent electrodes 108 where strong electric fields are formed towards edges of the discharge cells.

After the discharge is generated as described above, the voltage difference between the X electrodes 104 and the Y electrodes 105 is reduced below a discharge voltage. Thus, a further discharge is not generated, but space charges and wall charges are accumulated in the discharge cells.

When the polarities of the voltages supplied to the X electrodes 104 and the Y electrodes 105 are reversed, the discharge is re-generated with the aid of the wall charges. In this way, if the polarities of the X electrodes 104 and the Y electrodes 105 are reversed, the discharge process is repeated. In this manner, the discharge is stably generated by repeating the above process.

Ultraviolet rays generated by the discharge excite the red, green, and blue phosphor layers 119 coated in each of the discharge cells. The excited phosphor layers 119 generate visible light which realizes a stationary or moving image by being emitted from the discharge cells.

Since the PDP 100 employs the X-YY structure, the X bus electrode 107 is disposed on the single walled barrier rib 117 disposed between the first discharge cell 120A and the second discharge cell 120B which are adjacently disposed in the Y direction of the PDP 100. Therefore, the X bus electrode 107 commonly relates to the discharge in the first discharge cell 120A and the second discharge cell 120B.

Also, the first X protrusion electrode 107*b* and the second X protrusion electrode 107*c* protrude from the X bus electrode lines 107*a* on the second barrier rib 116 towards the first discharge cell 120A and the second discharge cell 120B, and the Y protrusion electrodes 109*b* extend from the Y bus electrode line 109*a* on the second barrier ribs 116 towards the first discharge cell 120A and the second discharge cell 120B. Therefore, a surface discharge and a face discharge are possible in the discharge cells.

As described above, the PDP according to the present invention has the following advantages.

First, a barrier rib structure includes single walled barrier ribs and double walled barrier ribs, and discharge electrodes disposed on the single walled barrier ribs can commonly be related to adjacent discharge cells, thereby increasing the discharge areas.

Second, since the discharge areas are extended, the efficiency of generating ultraviolet rays that excite phosphor materials and the discharge aperture ratio can be increased.

Third, since the discharge spaces of the discharge cells are asymmetrically formed, the brightness of discharge cells having relatively low brightness can be increased.

Fourth, when discharge electrode lines are disposed on the barrier ribs, line widths of the electrodes can be formed to be different from each other. Accordingly, the problem of the asymmetrical discharge spaces of the discharge cells can be resolved.

Fifth, since protrusion electrodes extending from the discharge electrode lines are disposed on the barrier ribs, reflection brightness caused by external light can be reduced, thereby increasing the bright room contrast of the PDP.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A Plasma Display Panel (PDP) comprising:

a first substrate and a second substrate;

a plurality of barrier ribs arranged between the first and second substrates to define discharge cells, the plurality of barrier ribs including first barrier ribs and second barrier ribs, said second barrier ribs including single walled barrier ribs that are parallel to each other and between each and every discharge cell, said first barrier ribs including single walled barrier ribs and double walled barrier ribs that are parallel to each other, said first barrier ribs are disposed perpendicular and connected to said second barrier ribs;

a plurality of discharge electrodes arranged on portions of the panel corresponding to the barrier ribs to supply a discharge voltage to the discharge cells; and phosphor layers arranged in the discharge cells, wherein the single walled barrier ribs of the second barrier ribs have a uniform width, wherein the single walled barrier ribs of the first barrier ribs are disposed between adjacent discharge cells and the double walled barrier ribs of the first barrier ribs disposed between a pair of discharge cells with the single walled barrier ribs of the first barrier ribs between the double walled barrier ribs of the first barrier ribs, wherein the double walled barrier ribs of the first barrier ribs have a gap between the double walls discharging exhaust gas when the discharged cells are vacuumed sealed, and wherein the single walled barrier ribs of the first barrier ribs are wider at the point of contact with discharge cells having a red phosphor layer and narrower and of uniform width at the point of contact with discharge cells having a green or blue phosphor layer.

2. The PDP of claim 1, wherein the discharge spaces of the discharge cells are defined by the barrier ribs into discharge cells having different discharge spaces from each other.

3. The PDP of claim 2, wherein the discharge spaces of the discharge cells are of different sizes.

4. The PDP of claim 2, wherein the discharge spaces of the discharge cells are defined to have different areas corresponding to changes of the thickness of the barrier ribs.

5. The PDP of claim 1, wherein the gaps in the double wall barrier ribs are arranged in a direction of the PDP to be used as a path for discharging an exhaust gas.

6. The PDP of claim 1, wherein the discharge electrodes comprise X and Y electrodes, each of the X electrodes comprising an X transparent electrode and an X bus electrode electrically connected to the X transparent electrode, and each of the Y electrodes comprising a Y transparent electrode and a Y bus electrode electrically connected to the Y transparent electrode.

7. The PDP of claim 6, wherein each of the X bus electrodes comprises an X bus electrode line and a plurality of X protrusion electrodes, the X bus electrode line is arranged on the single wall barrier rib, and the X protrusion electrode comprises a first X protrusion electrode and a second X protrusion electrode respectively arranged on the second harrier ribs connected to both sides of a single wall barrier rib.

8. The PDP of claim 6, wherein the X transparent electrodes respectively protrude into the discharge spaces of the adjacent discharge cells from the both sides of the X bus electrode line.

9. The PDP of claim 6, wherein each of the Y bus electrodes comprises a Y bus electrode line and a plurality of Y protrusion electrodes extending from the Y bus electrode line, the Y bus electrode line is arranged on the double wall barrier rib, and the Y protrusion electrodes are arranged on the second barrier ribs.

10. The PDP of claim 6, wherein the Y transparent electrodes respectively protrude into the discharge spaces of the discharge cells from a side of the Y bus electrode line.

11. The PDP of claim 6, wherein the single wall barrier ribs have different widths in different discharge cells corresponding to variations of widths of the X bus electrode in each of the discharge cells.

12. The PDP of claim 6, wherein an area of the discharge space of the discharge cell in which the X bus electrode has a relatively wide width is smaller than an area of the discharge space of the discharge cell in which the X bus electrode has a relatively narrow width.

13. The PDP of claim 6, wherein the discharge electrode has an X-YY structure in which the X electrodes that commonly relate to the discharge in the adjacent discharge cells are disposed on the single wall barrier ribs and the Y electrodes are disposed on the double wall barrier ribs.

* * * * *